United States Patent [19]

Simon et al.

[11] Patent Number: 4,887,074

[45] Date of Patent: Dec. 12, 1989

[54] LIGHT-EMITTING DIODE DISPLAY SYSTEM

[76] Inventors: Michael Simon; Benjamin Roque, both of 870 Robinhood Dr. #11, Reno, Nev. 89509

[21] Appl. No.: 145,898

[22] Filed: Jan. 20, 1988

[51] Int. Cl.[4] ..... G09G 3/32

[52] U.S. Cl. ..... 340/782; 340/762; 340/815.03; 313/500

[58] Field of Search ..... 340/762, 782, 767, 750, 340/766, 815.03; 313/500

[56] References Cited

U.S. PATENT DOCUMENTS

| | | | |
|---|---|---|---|
| 3,673,461 | 6/1972 | Eisenberg . | |
| 3,676,745 | 7/1972 | Traweek . | |
| 3,764,856 | 10/1973 | Martin . | |
| 3,778,650 | 12/1973 | Tharman . | |
| 3,909,679 | 9/1975 | Petri . | |
| 3,932,773 | 1/1976 | Luscher et al. . | |
| 4,070,663 | 1/1978 | Kanatani et al. . | |
| 4,132,465 | 1/1979 | Rode et al. . | |
| 4,241,277 | 12/1980 | Hintze et al. | 313/500 |
| 4,253,097 | 2/1981 | Hochstrate . | |
| 4,298,869 | 11/1981 | Okuno . | |
| 4,342,947 | 8/1982 | Bloyd | 340/782 |
| 4,420,711 | 12/1983 | Takahashi et al. | 340/782 |
| 4,445,132 | 4/1984 | Ichikawa et al. | 340/782 |
| 4,546,410 | 10/1985 | Kaufman . | |
| 4,574,330 | 3/1986 | Cohen et al. . | |
| 4,595,920 | 6/1986 | Runyan . | |
| 4,654,753 | 3/1987 | Turk et al. . | |

FOREIGN PATENT DOCUMENTS

| | | | |
|---|---|---|---|
| 0216348 | 4/1987 | European Pat. Off. | 340/782 |
| 0197063 | 10/1985 | Japan | 340/782 |

*Primary Examiner*—Gerald Brigance
*Attorney, Agent, or Firm*—Alfred A. Equitz

[57] ABSTRACT

A computer-controlled LED display system including an N×M rectangular array of light units. Each light unit includes one or more LED's that are driven so as to emit a train of light pulses separated by intervals of substantially zero light intensity. The temperature of the LED cathodes will decrease during each interval of zero emitted light intensity, so that the average temperature of each LED over its operating period will be less thaN it would be with zero intensity intervals of shorter duration. In a preferred embodiment, the drive circuit has a nonzero, finite RC constant and a capacitor connected in series with the LED's, so as to produce sufficiently long duration, substantially zero intensity intervals between the emitted light pulses. Each LED driving circuit includes a switch (preferably of the optocoupler or triac type) for switching the circuit between "on" and "off" modes. Each switch is controlled by serial digital signals supplied via an interface unit. The interface unit includes a serial-to-parallel converter and a parallel-in-parallel-out shift register for each of the M columns of the light unit array. Each serial-to-parallel converter-shift register pair accepts serial digital control pulses and generates N parallel data streams, each controlling one of the N light units in the Mth array column.

21 Claims, 4 Drawing Sheets

LIGHT-EMITTING DIODE DISPLAY SYSTEM

FIELD OF THE INVENTION

The invention relates to light-emitting diode ("LED") display systems of the type that may be interfaced with, and controlled by, a computer. More particularly, the invention relates to computer controlled LED display systems that include means for driving each LED to operate with an operating cycle including "on" periods separated by "off" periods of sufficient duration so that the LED may cool during each "off" period.

BACKGROUND OF THE INVENTION

Conventional LED display systems include arrays of light units, with each light unit including one or more LED's. It is conventional to interface such LED display systems to a computer so that the computer may supply control signals to selectively activate individual ones of the light units.

However, the efficiency and lifetime of the individual LED's employed in such systems has been limited due to the high junction temperature of each LED, resulting from the large amount of heat generated in each LED while it emits light. Additionally, the use of square wave control signals to switch each LED between an "on" and an "off" mode has resulted in radiation of a substantial amount of radio frequency interference. Further, the interface between the computer controller and the light units in such conventional systems has typically had complicated design.

It has not been known until the present invention how to construct an LED display system so as to avoid all of these problems.

SUMMARY OF THE INVENTION

The invention is a computer-controlled LED display system including an N×M rectangular array of light units. Each light unit includes one or more LED's. Each LED is driven so as to emit a train of light pulses separated by intervals of substantially zero light intensity. The temperature of the LED cathodes will decrease during each interval of zero emitted intensity, so that the average temperature of each LED over its operating period will be less than it would be with zero emitted intensity intervals of shorter duration. In a preferred embodiment, the drive circuit has a nonzero, finite RC constant, and a capacitor connected in series with the LED's, in order to produce sufficiently long duration, substantially zero intensity intervals between the emitted light pulses.

Each driving circuit includes a switch (preferably of the opto-coupler or triac type) for switching the circuit between "on" and "off" modes. Each switch is controlled by serial digital signals supplied via an interface unit. The interface unit includes a serial-to-parallel converter and a parallel-in-parallel-out shift register for each of the M columns of the rectangular light unit array. The serial-to-parallel converter-shift register pair accepts serial digital data (supplied, for example, from a computer) and generates N parallel streams of data. Each of the parallel data streams controls one of the N light units in the Mth array column.

A separate latch enable line is provided to update the array. The array is updated only at instants of zero voltage crossing, to minimize generation of radio frequency interference.

DETAILED DESCRIPTION OF THE PREFERRED EMBODIMENTS

Figure 1:
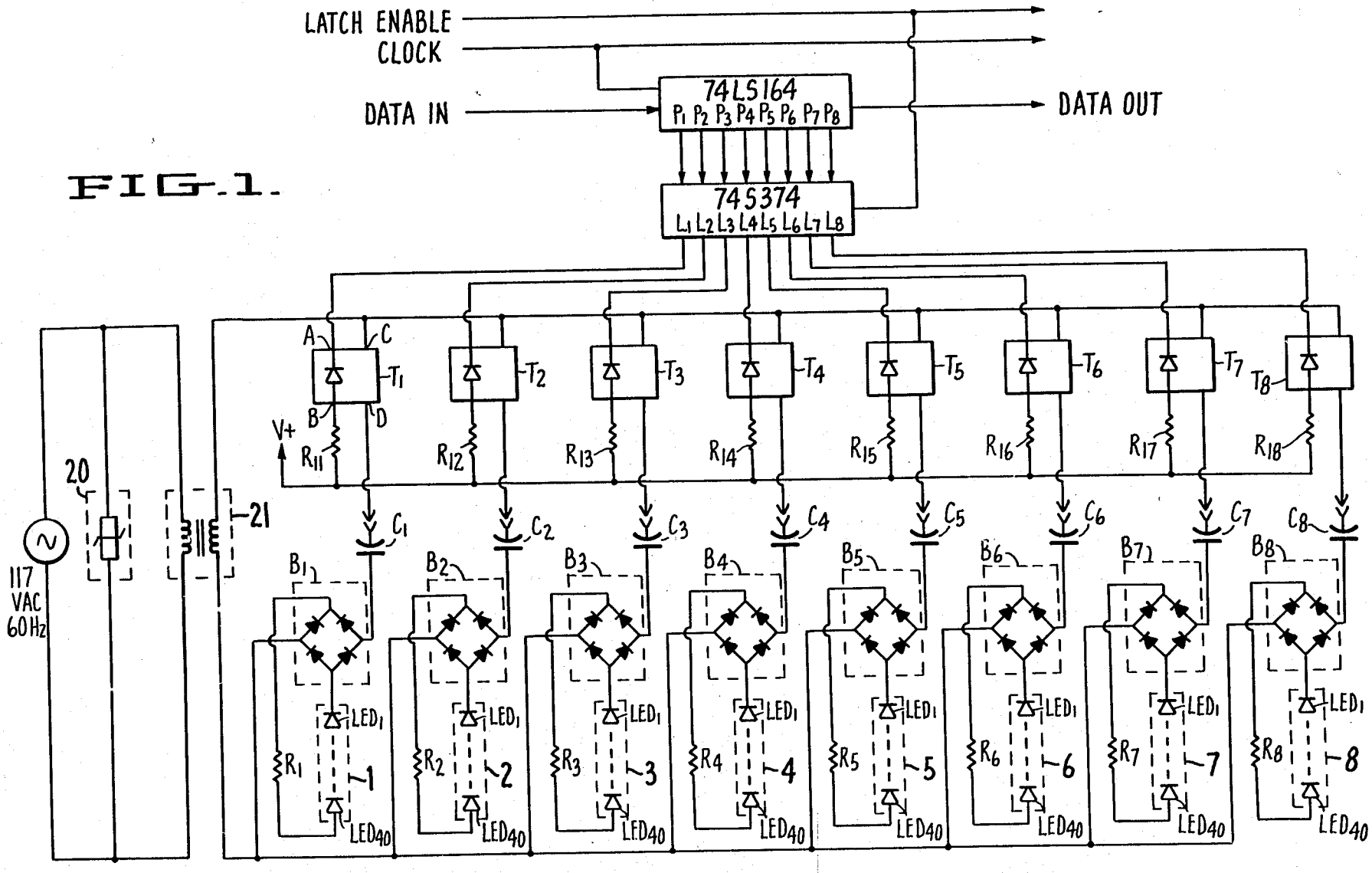
FIG. 1 is a circuit diagram of a preferred embodiment of the inventive system including an eight row, one column, light unit array, where each light unit in the array includes forty LED's.

FIG. 1 shows light units 1 through 8 that comprise the single column of an 8×1 array of light units. Each light unit includes forty LED's, identified in FIG. 1 as $LED_1$ through $LED_{40}$. Although forty LED's are included in each light unit in FIG. 1, it is contemplated that more than forty or less than forty LED's may comprise each light unit.

The 117 VAC, 60 Hz voltage source shown in FIG. 1 supplies AC power to light units 1 through 8. Transient limiting device 20 which is preferably a metal oxide varistor as shown in FIG. 1) shunts the line voltage to limit power surges and other undesired transients. Although transient limiting device 20 is preferably a metal oxide varistor, other transient limiting devices may alternatively be employed as transient limiting device 20. Transformer 21 reduces the 117 VAC line voltage to a lower peak-to-peak AC voltage suitable for driving the LED's used in the system. Transformer 21 may optionally be omitted in alternative embodiments of the inventive system.

The triad output (D) of each of identical opto-couplers $T_1$ through $T_8$ switches power off or on to the light unit connected thereto in response to digital control signals received on lines $L_1$ through $L_8$ from integrated circuit 74S374. IC 74S374 functions as a parallel-to-parallel shift register which receives eight parallel data streams from integrated circuit 74LS164 on lines $P_1$ through $P_8$.

One of identical resistors $R_{11}$ through $R_{18}$ is connected to the diode input (B) of each opto-coupler to hold such diode input at high potential V+ as shown in FIG. 1. The high potential V+ will be +5 volts in one preferred embodiment of the invention. The AC voltage source is connected via transformer 21 to the triad input (C) of each opto-coupler. Thus when a suitable amplitude (negative) digital signal is supplied from IC 74S374 to the diode output (A) of one of opto-couplers $T_1$ through $T_8$, current will flow to ground from the high potential side (of the circuit including the diode portion of the opto-coupler and the relevant one of resistors $R_{11}$ through $R_{18}$), thus generating an appropriate gate signal that is supplied to the triad portion of the opto-coupler to permit alternating current to flow between the triad input (C) and the triad output (D) of the opto-coupler, thus switching the light unit connected to the triad output into an "on" mode. The diode component of a conventional opto-coupler of the type suitable for use in the inventive system will be an LED, optically coupled to the triad portion of the opto-coupler (so that the gate signal to the triad's gate input will be a light signal).

Each subcircuit of FIG. 1 including an opto-coupler (one of units $T_1$ through $T_8$), the resistor connected thereto (one of resistors $R_{11}$ through $R_{18}$) and the V+ voltage source, may be replaced by a triac (bidirectional triode thyristor) having its gate connected to IC 74S374, or may be replaced by another device having the switching characteristics of the opto-coupler subcircuit described above.

When one of the opto-couplers (for example, $T_1$) has been switched into its "on" mode, the alternating current supplied to the associated light unit (for example, light unit 1) is rectified in the associated one of full-wave rectifiers $B_1$ through $B_8$ (for example, B1). Rectified AC current will thus flow through the light unit and the one of resistors $R_1$ through $R_8$ connected in series with said light unit (for example, $R_1$). One of capacitors $C_1$ through $C_8$ is connected in series with the AC voltage source and each rectifier.

Figure 2:
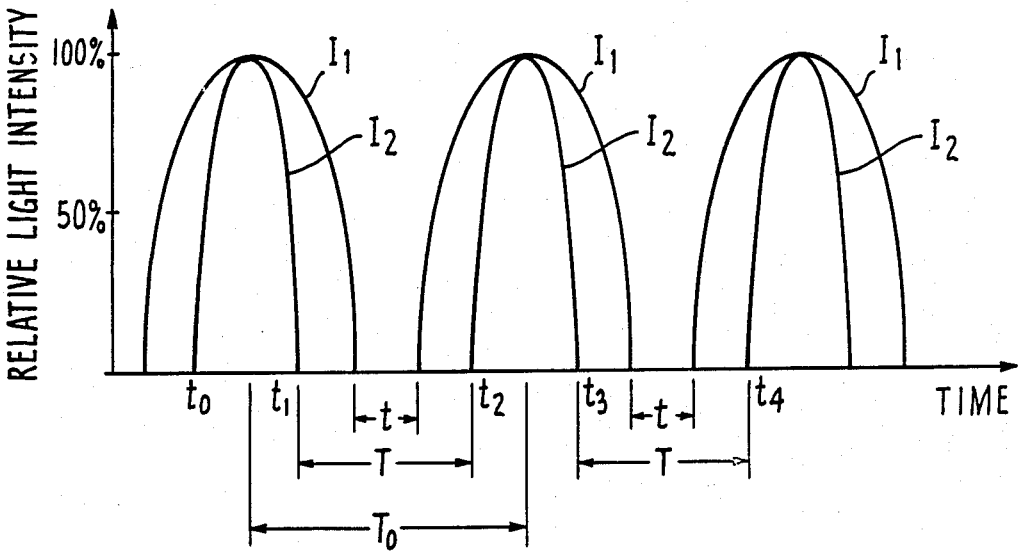
FIG. 2 is a graph of relative light intensity versus time that indicates the output of two light-emitting diodes, one of which (represented by intensity curve $I_2$) is driven by the inventive system.

The capacitance of each of capacitors $C_1$ through $C_8$ is selected so that the RC time constant of each subcircuit comprising the associated rectifier, light unit, and opto-coupler (in its "on" state), the associated one of resistors $R_1$ through $R_8$, and transformer 21, is finite and nonzero. This finite, nonzero RC constant will cause each LED of the light unit to emit light pulses having intensity similar to those represented by light intensity curve $I_2$ of FIG. 2, if the output of transformer 21 is a sinusoidal voltage signal having the same frequency ($f=1/T_o$) as the pulses of curve $I_2$. Curve $I_2$ consists of nonzero light pulses (i.e., the pulse between $t_0$ and $t_1$, and the pulse between $t_2$ and $t_3$) separated by intervals, having duration T, of substantially zero intensity (i.e., the interval between $t_1$ and $t_2$, and the interval between $t_3$ and $t_4$). Curve $I_1$ of FIG. 2 represents the light that each LED would emit if the capacitors of the FIG. 1 system would be replaced by short circuits (so that the RC time constant of such altered system would be reduced to zero). The light pulses of curve $I_1$ are separated by intervals of duration t (where t is less than T) of substantially zero intensity. The vertical axis of the FIG. 2 graph indicates relative intensity, i.e., the actual emitted intensity at any instant divided by the maximum intensity emitted during the system's operating cycle.

Thus, the function of capacitors $C_1$ through $C_8$ is to decrease the duty cycle of each LED, so that each LED emits light during a shorter interval of its operating cycle than if the capacitors would be omitted. Omission of the capacitors would cause the drive circuit's impedance to be purely resistive, with no reactive component due to capacitance. This decreased duty cycle allows each LED more time in which to dissipate heat, so that the average temperature of each LED during its operating cycle is less than the average temperature that would exist absent the capacitors. The finite, nonzero RC constant of the inventive driving circuit accomplishes this objective by introducing a phase shift between the voltage signal emerging from transformer 21 and the current flowing through each LED. During the intervals in which each LED is "off" (i.e., emits no light), heat will radiate away from the LED, and preferably, will also be conducted away from the LED to a heat sinking potting substance in thermal contact with the LED's cathode.

Inclusion of a capacitor in series with the opto-coupler of the drive circuit, the AC voltage source, and the drive circuit's rectifier (as shown in FIG. 1) will not increase the power loss or heat generation in the drive circuit to an amount greater than the power loss or heat generation that would exist without inclusion of the capacitor.

Figure 3:
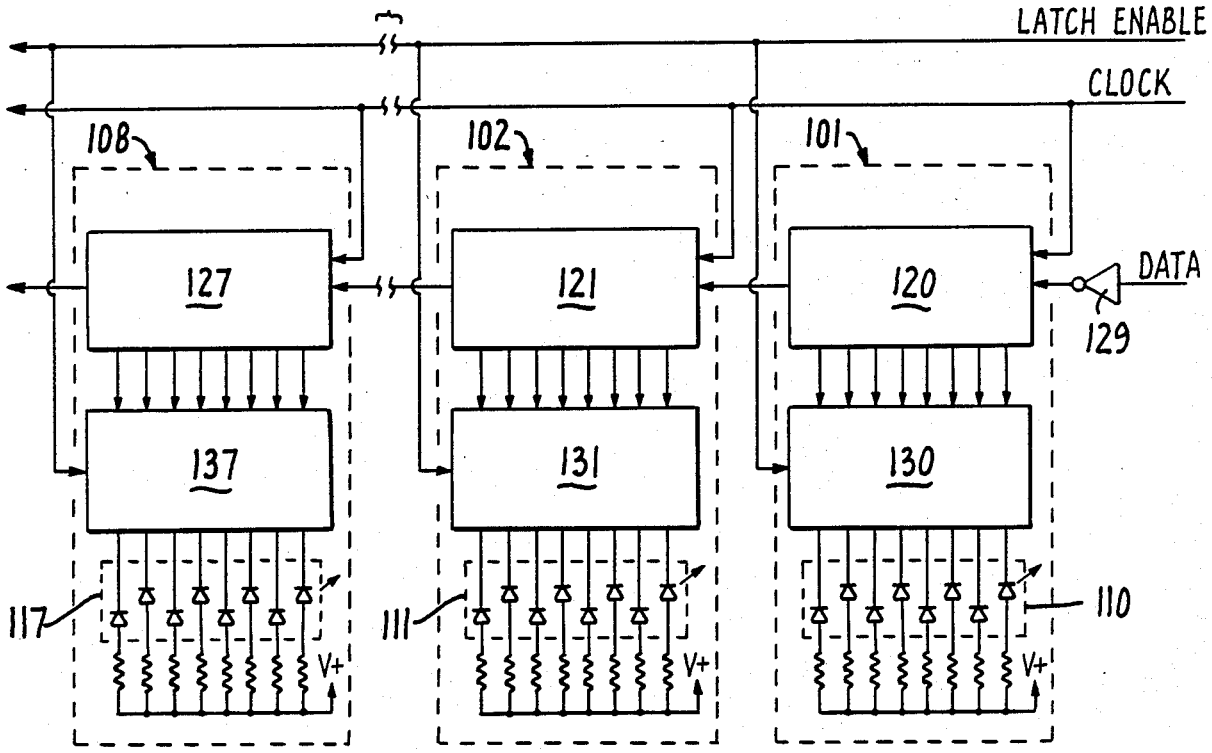
FIG. 3 is a circuit diagram of a preferred embodiment of the inventive system showing the circuitry for supplying three of the system's eight columns of light units with digital control signals. Each column of light units includes eight light units of the type shown in FIG. 1.

FIG. 3 shows a portion of a preferred embodiment of the inventive system that includes an 8 row $\times$8 column array of light units. Each of identical circuits 101 through 108 (only circuits 101, 102, and 108 are shown in FIG. 3 for simplicity) supplies conrol pulses to a different column of light units. Each of the eight diodes within box 110 of circuit 101 corresponds to the diode portion (having input port B and output port A) of one of opto-couplers $T_1$ through $T_8$ of FIG. 1. The additional drive circuitry connected to the opto-couplers of FIG. 1 (including the AC voltage source, transformer, capacitors, full-wave rectifiers, and the LED's themselves) should also connected to diodes 110 of FIG. 3 (though this circuitry is not shown in FIG. 3 for simplicity). Similarly, diodes 111 and diodes 117 should be connected to drive circuitry of the type shown in FIG. 1. For reasons of circuit economy, the eight drive circuits controlled by circuits 101 through 108 will preferably share a common alternating voltage source (including any associated transient limiting device and transformer). However, a separate alternating voltage source may be provided for each driving circuit.

A clock signal, a stream of digital data, and a latch enable signal are supplied to the FIG. 3 circuit from a computer. The data is inverted in inverter 129 to enable the control circuitry to employ negative logic, so that the output of parallel-in-parallel-out shift registers 130 through 137 may sink the load current rather than source it. This enables shift registers 130 through 137 to drive the diode inputs of the opto-couplers directly.

Registers 120 through 127 function as serial shift registers in that they receive the inverted serial input data and the clock signal on the right side of the inventive system, and shift the data to the left with each negative to positive transition of the clock signal. Each of registers 120 through 127 also functions as a serial-to parallel converter in that it also outputs parallel data streams to the parallel-in-parallel-out shift register (one of registers 130 through 137) connected thereto. Registers 120 through 127 and 130 through 137 are eight bit registers in the embodiment shown in FIG. 3. Each has eight parallel output ports.

The separate latch enable line supplies enable signals to registers 130 through 137 to cause registers 130 through 137 to update the light unit array at 60 or 120 frames per second. The updating pulses are timed to coincide with the zero crossings of the alternating voltage source that powers each drive circuit, in order to minimize generation of radio frequency interference on the alternating voltage source side of the circuit, to ensure compliance with applicable government regulations on radio frequency emissions from digital equipment.

Thus, the light unit array is capable of displaying an image (which may be text or graphics) that moves across the array from column to column or from row to row, and which may be updated 60 or 120 times each second.

An 8×8 array of light units is desirable because eight is an even binary number, so that row and column decoding is a simple digital procedure for an 8×8 light unit array, and also because eight is a typical number of data lines on conventional parallel output ports, and eight is a typical number of outputs on conventional shift registers and latches. For an 8×8 array of the type described with reference to FIG. 3, we prefer to employ 74LS164 integrated circuits as 8 bit registers 120 through 127, and 74S374 integrated circuits as 8 bit registers 130 through 137.

It is specifically contemplated, however, that M×N light unit arrays other than 8×8 arrays may be included in the inventive system. It will be apparent to those of ordinary skill in LED display circuit design how to select appropriate registers from those commercially available for use in such alternative embodiments of the inventive system. It is also contemplated that several light unit arrays, each driven by circuitry of the type described with reference to FIGS. 1 and 3, may be attached together (horizontally or vertically) in modular fashion to build larger systems of computer-controlled light unit arrays.

Figure 4:
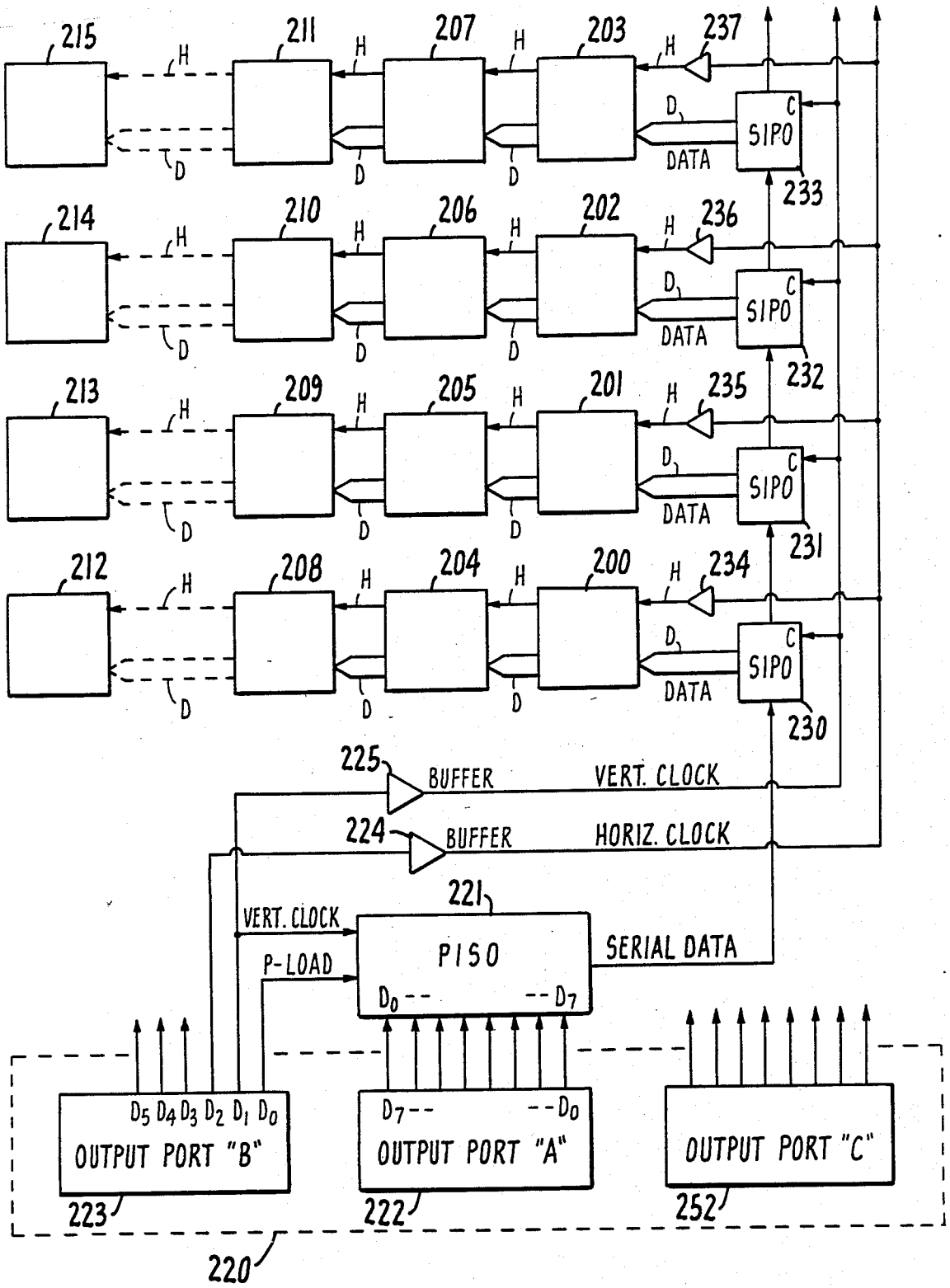
FIG. 4 is a circuit diagram of a preferred embodiment of the inventive system showing the circuitry for supplying digital control signals to sixteen light unit arrays, each array including 64 light units arranged in eight row, eight column order.

FIG. 4 represents sixteen light unit arrays 200 through 215 (and other arrays not shown) arranged in four vertical layers. The bottom layer includes arrays 200, 204, 208, 212, and a number of additional arrays (not shown) between arrays 208 and 212. The other layers include the same number of arrays as the bottom layer. Each of arrays 200–215 includes 64 light units, arranged in eight row, eight column order.

For specificity, the remaining description of FIG. 4 shall assume that there are eight light unit arrays in each layer.

Each of serial-in-parallel-out registers 230–233 supplies data to the associated one of 8×8 arrays 200–203.

The data is supplied from computer system 220 in the following manner. A first byte of data is supplied to parallel-in-serial-out shift register 221 from parallel output port 222 of computer 220 on lines $D_0$–$D_7$ of port 222. A software-generated "parallel load" pulse is then supplied to the "parallel load" input of register 221 from parallel output port 223 on line $D_0$ of port 223. The parallel load pulse disables line $D_0$ of port 223, while software within computer 220 causes eight clock bits to be sent to input terminal "C" of register 221, and through buffer 225 to each of registers 230, 231, 232, and 233. This shifts the first byte of data to register 230, and simultaneously shifts the contents of register 230 to 231, the contents of register 231 to 232, the contents of register 232 to 233, and so on.

Next, a second byte is supplied from memory 220 to register 221, and the process is repeated. The process is repeated four times to load registers 230 through 233.

When registers 230–233 have been loaded in this manner, a software-generated pulse (a "horizontal" clock pulse) is supplied from port 223 on line $D_2$ through buffer 224 to drive each of buffers 234, 235, 236, and 237 into a "high" state. The output of each of buffers 234–237 then clocks the eight parallel data bits from each of registers 230–233 into eight serial shift registers in each array of the associated layer. For example, each parallel data bit from register 230 is clocked into a serial register corresponding to register 120 of FIG. 3. Each horizontal clock pulse from buffer 234 is also supplied on line H to a serial register in each of arrays 204 through 212 (i.e., into serial registers corresponding to registers 121 through 127 of FIG. 3), to clock data from each such serial register to the serial register adjacent thereto.

The process described above is repeated sixty-four times (or more generally, eight times for each array in one of the vertical layers of the type shown in FIG. 4) to drive each light unit in the display into a desired state. By so repeating the process, each serial register in each array effectively receives a stream of serial digital control signals from output port 222.

In a preferred embodiment, two sets of light units are included in each light unit array (for example, in each of arrays 200–215 of FIG. 4). Each LED in the first set of light units emits green light, and each LED in the second set emits red light. The light units are preferably arranged so that each consists of N×M pairs of adjacent red and green light units. Two independent driving circuits are included, one for driving the red light units and the other for driving the green light units. If both driving circuits simultaneously supply identical driving signals to the light units in a regreen light unit pair, then the light unit pair will appear to emit gold light. If only one driving circuit supplies a signal to the pair, the pair will emit either green or red light (depending on which driving circuit supplies the signal).

If the light unit arrays in FIG. 4 include redgreen light unit pairs as described in the preceding paragraph, the FIG. 4 circuitry is modified in the following manner to supply driving signals to the red-green light unit pairs. Third output port 252 of computer 220 (identical to port 222) supplies bytes (each consisting of eight bits) to a parallel-in-serial-out register identical to register 221 (but not shown in FIG. 4 for simplicity). Three additional lines of output port 223 (for example, the lines $D_3$, $D_4$, and $D_5$) are employed for supplying software-generated clocking signals to a set of registers identical to registers 230–233 (but not shown in FIG. 4 for simplicity) as described above with reference to the signals supplied from port 223 on lines $D_0$ through $D_2$.

Figure 5:
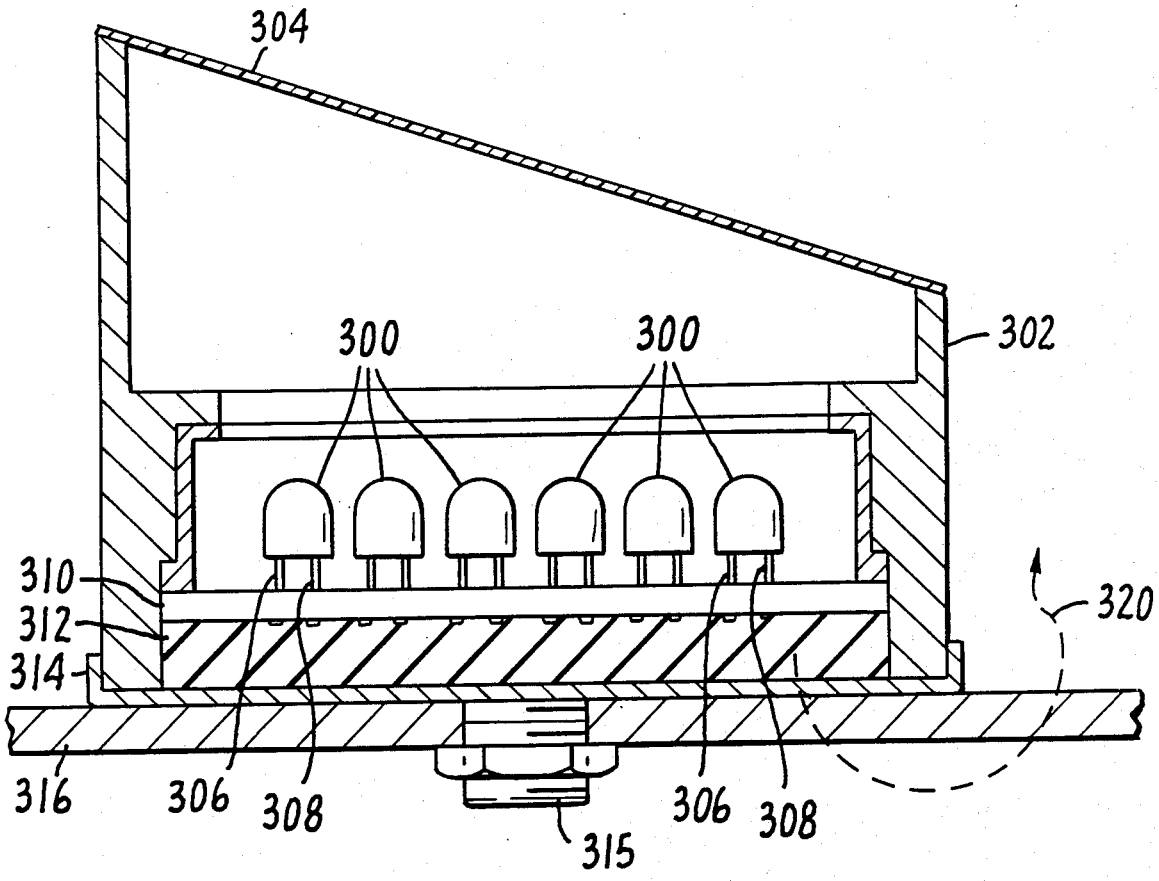
FIG. 5 is a cross-sectional view of a single light unit of the type used in a preferred embodiment of the inventive system.

A preferred configuration for an individual light unit is shown in FIG. 5. Light-emitting diodes 300 are mounted on printed circuit board 310. Each LED has a cathode lead 306 and an anode lead 308. Each cathode lead and anode lead is embedded in thermal contact with heat sinking potting compound 312. Potting compound 312, which is thermally conducting but electrically insulating, is contained within housing 302 and backing plate 314. Backing plate 314 is attached to housing panel 316, such as by screw 315. An optical filter 304 may be positioned so that light emitted by LED's 300 is transmitted through filter 304. Filter 304 may be selected to alter the transmitted light so that it has a desired hue.

The intensity and hue of the light emitted by each LED depends on the thermal condition of each individual light emitting diode junction. Under typical operating conditions, each LED must be driven with relatively high power, so that considerable heat will be generated at each LED. If this heat is not dissipated at a rate approaching the rate at which it is generated, junction temperature will rise considerably, with the effect that junction efficiency will considerably decrease. In order to produce brilliant, attractive appearing light, the junction of each LED should be driven so as to produce near maximum light output. In order for the LED's to maintain this level of output, the LED junctions must be cooled.

The FIG. 5 embodiment efficiently dissipates heat from LED's 300 because cathode leads 306, anode leads 308, and circuit board 310 are in direct thermal contact with heat sinking potting compound 312. Imbedding the heat generating elements of the system (leads 306, 308, and the electrically conductive elements connected thereto, such as solder, and circuit board 310) in thermally conducting, electrically insulating compound 312 maximizes the thermal contact between these heat generating elements and the heat dissipating elements of the system. Backing plate 314 is preferably aluminum, and housing panel 316 is preferably thermally conducting, so that heat (represented by arrow 320) may flow from the vicinity of each LED to the medium surrounding the inventive system.

Although imbedding circuit board 310 in potting compound 312 has the disadvantages of preventing easy repair of the board, and increasing the cost and weight of the system, it has the advantages of increasing LED operating life while producing high light output, increasing "light to heat" ratios, increasing system mechanical strength, and isolating the LED's and associated circuitry from destructive atmospheres.

The foregoing description is merely illustrative and explanatory of the inventive system. Various changes in the details of the embodiments described herein may be within the scope of the appended claims.

We claim:

1. A display system, including:

at least one LED;

a drive circuit having a finite, nonzero RC time constant, including a capacitor connected in series with the at least one LED, and capable of driving the at least one LED into a light-emitting mode in response to an alternating voltage signal, in which light-emitting mode each driven LED emits a train of light pulses separated by intervals of substantially zero light intensity, and in which light-emitting mode the drive circuit introduces a phase shift between the alternating voltage signal and the current through each driven LED to increase the duration of the substantially zero light intensity intervals beyond the duration said intervals would have if the capacitance of the drive circuit were zero, so as to reduce the average temperature of each LED in the light emitting mode below the average temperature each said LED would have if the capacitance of the drive circuit were zero;

a switch coupled with the drive circuit, and capable of switching in response to control signals between an on position in which the alternating voltage signal is supplied through the switch to the drive circuit, and an off position preventing the alternating voltage signal from propagating through the switch to the drive circuit; and a drive controller coupled to the switch, for generating control signals and supplying said control signals to said switch, wherein each of the control signals coincides with a zero crossing of the alternating voltage signal.

2. The system of claim 1, also including an AC power source that supplies said alternating voltage signal to the drive circuit.

3. The system of claim 2, wherein the drive circuit includes a full-wave rectifier connected between the AC power source and the at least one LED, for supplying full-wave rectified power to the at least one LED.

4. The system of claim 3, wherein the capacitor of the drive circuit is connected in series between the rectifier included in said drive circuit and the AC power source.

5. The system of claim 1, wherein the switch is an opto-coupler, whose triad output is connected to the drive circuit.

6. The system of claim 1, including a first LED connected to the driving circuit and a second LED; a second drive circuit having a finite, nonzero RC time constant, including a capacitor connected in series with the second LED, and capable of driving the second LED into a light-emitting mode in response to an alternating voltage signal, in which light-emitting mode the second LED emits a train of light pulses separated by intervals of substantially zero light intensity, and in which light-emitting mode the second drive circuit introduces a phase shift between the alternating voltage signal and the current through the second LED to increase the duration of the substantially zero light intensity intervals beyond the duration said intervals would have if the capacitance of the second drive circuit were zero, so as to reduce the average temperature of each LED in the light emitting mode below the average temperature the second LED would have if the capacitance of the second drive circuit were zero;

a second switch coupled with the second drive circuit, and capable of switching in response to control signals between an on position in which the alternating voltage signal is supplied through the second switch to the second drive circuit, and an off position preventing the alternating voltage signal from propagating through the second switch to the second drive circuit;

wherein both the switch and the second switch are coupled to the drive controller, and wherein the drive controller is capable of receiving serial digital control pulses and supplying the digital control pulses in parallel form to the switches.

7. The system of claim 6, also including means for receiving parallel digital control pulses and supplying a subset of the parallel digital control pulses to the drive controller in serial form.

8. The system of claim 1, including a first LED connected to the driving circuit and a second LED; a second drive circuit having a finite, nonzero RC time constant, including a capacitor connected in series with the second LED, and capable of driving the second LED into a light-emitting mode in response to an alternating voltage signal, in which light-emitting mode the second LED emits a train of light pulses separated by intervals of substantially zero light intensity, and in which light-emitting mode the second drive circuit introduces a phase shift between the alternating voltage signal and the current through the second LED to increase the duration of the substantially zero light intensity intervals beyond the duration said intervals would have if the capacitance of the second drive circuit were zero, so as to reduce the average temperature of each LED in the light emitting mode below the average temperature the second LED would have if the capacitance of the second drive circuit were zero;

a second switch coupled with the second drive circuit, and capable of switching in response to control signals between an on position in which the alternating voltage signal is supplied through the second switch to the second drive circuit, and an off position preventing the alternating voltage signal from propagation through the second switch to the second drive circuit;

wherein the first drive circuit is capable of driving the first LED so that the first LED emits light of a first color, and the second driving circuit is capable of driving the second LED so that the second LED emits light of a second color.

9. The system of claim 1, wherein each LED includes a cathode lead and an anode lead, and also including:

a circuit board, to which each LED cathode lead and LED anode lead is attached; and a thermally conductive, electrically insulating potting compound, in which the circuit board, and each LED cathode lead and LED anode lead, are imbedded.

10. A display system, including:

an N×M array of light units, each light unit including at least one LED;

a drive circuit coupled with each light unit, each drive circuit having a finite, nonzero RC time constant, including a capacitor connected in series with the at least one LED, and being capable of driving the light unit coupled thereto into a light-emitting mode in response to an alternating voltage signal, in which light-emitting mode the light unit emits a train of light pulses separated by intervals of substantially zero light intensity, and in which light-emitting mode the drive circuit introduces a phase shift between the alternating voltage signal and the current through each light unit to increase the duration of the substantially zero light intensity intervals beyond the duration said intervals would have if the capacitance of the drive circuit were zero, so as to reduce the average temperature of the light unit in the light emitting mode below the average temperature the light unit would have if the capacitance of the drive circuit were zero;

a switch coupled with each drive circuit, capable of switching in response to control signals between an on position in which the alternating voltage signal is supplied through the switch to the drive circuit, and an off position preventing the alternating voltage signal from propagating through the switch to the drive circuit; and a drive controller for generating control signals and supplying said control signals to each said switch, wherein each of the control signals coincides with a zero crossing of the alternating voltage signal.

11. The system of claim 10 wherein the drive controller includes;

M interface units, where each interface unit is connected to a different set of N switches in turn coupled to the light units comprising one of the N rows of the N×M array, for receiving serial digital control pulses and supplying the digital control pulses in parallel form to the set of switches connected thereto.

12. The system of claim 11, wherein each interface unit includes:

a serial-to-parallel converter having a serial input port that is capable of receiving the serial digital control pulses, a serial output port connected in series to at least one other of the interface units, and at least N output ports; and a parallel-in-parallel-out shift register having at least N input ports, each connected to an output port of the serial-to-parallel converter, and at least N output ports, each output port connected to a different one of the N switches.

13. The system of claim 12, wherein the drive controller includes an inverter connected in series with the serial-to-parallel converters so as to invert the serial digital control pulses before they are received by the serial-to-parallel converters.

14. The system of claim 11, also including means for receiving parallel digital control pulses and supplying a subset of the parallel digital control pulses to the drive controller in serial form.

15. The system of claim 10, also including an AC power source that supplies the sinusoidal voltage signal to each drive circuit.

16. The system of claim 15, also including a full-wave rectifier connected between the AC power source and each light unit, for supplying full-wave rectified power to each light unit connected thereto.

17. The system of claim 16, wherein the capacitor of each drive circuit is connected in series between the full-wave rectifier and the AC power source.

18. The system of claim 10, wherein each switch is an opto-coupler, whose triad output is connected to at least one drive circuit.

19. The system of claim 10, wherein N=8 and M=8.

20. The system of claim 10, including a first LED and a first drive circuit capable of driving the first LED so that the first LED emits light of a first color, and also including a second LED and a second driving circuit capable of driving the second LED so that the second LED emits light of a second color.

21. The system of claim 10, wherein each LED includes a cathode lead and an anode lead, and also including:

a circuit board, to which each LED cathode lead and LED anode lead is attached; and a thermally conductive, electrically insulating potting compound, in which the circuit board, and each LED cathode lead and LED anode lead, are imbedded.

* * * * *